US011272274B1

(12) United States Patent
Liu

(10) Patent No.: US 11,272,274 B1
(45) Date of Patent: Mar. 8, 2022

(54) AUDIO PLAYBACK DEVICE, PLAY TENT, AND PLAY CASTLE

(71) Applicant: DONGGUAN FUSHANG OUTDOOR PRODUCTS CO., LTD., Dongguan (CN)

(72) Inventor: Dawei Liu, Ankang (CN)

(73) Assignee: DONGGUAN FUSHANG OUTDOOR PRODUCTS CO., LTD., Dongguan (CN)

( * ) Notice: Subject to any disclaimer, the term of this patent is extended or adjusted under 35 U.S.C. 154(b) by 0 days.

(21) Appl. No.: 17/489,846

(22) Filed: Sep. 30, 2021

(30) Foreign Application Priority Data

Sep. 14, 2021 (CN) ..... 202122225184.X

(51) Int. Cl.
*H04R 1/02* (2006.01)
*H04R 5/02* (2006.01)
*A63H 33/00* (2006.01)

(52) U.S. Cl.
CPC ..... *H04R 1/025* (2013.01); *A63H 33/008* (2013.01); *H04R 5/02* (2013.01)

(58) Field of Classification Search
CPC ..... H04R 1/025; H04R 5/02; A63H 33/008
See application file for complete search history.

(56) References Cited

U.S. PATENT DOCUMENTS

2013/0280493 A1* 10/2013 Jackson ..... A63H 9/00 428/172
2020/0021918 A1* 1/2020 Huang ..... H04R 7/18

* cited by examiner

*Primary Examiner* — Simon King

(57) ABSTRACT

An audio playback device includes an audio player and a storage bin configured to accommodate the audio player. A bottom portion of the audio player is round table shaped. The bottom portion of the audio player extends radially outward to form a base. A touch panel is arranged on a top portion of the audio player and is configured to manually control playback of the audio player. The storage bin includes a soft cover configured to accommodate the audio player and an elastic ring connected to an opening of the soft cover. The elastic ring is configured to adjust a size of the opening of the soft cover. A bottom portion of the soft cover is fixed on a play tent. The base of the audio player contacts the play tent. At least a portion of a main body of the audio player extends from the elastic ring.

10 Claims, 5 Drawing Sheets

AUDIO PLAYBACK DEVICE, PLAY TENT, AND PLAY CASTLE

TECHNICAL FIELD

The present disclosure relates to a field of children's game toys, in particular to an audio playback device, a play tent, and a play castle applying the audio playback device.

BACKGROUND

There are many types of entertainment facilities for children. In recent years, entertainment equipment, such as play tents and play castles, have been popular with children. If these entertainment equipment are installed with an audio playback device that is able to emit music, animal sounds, vehicle sounds, nature sounds, stories, songs, and/or any other required sounds, and the audio playback devices are installed in the play tent and play castle, under a circumstance of ensuring safety of children, it realizes an effect of human-computer interaction with children, thereby allowing children to deepen an impression of a game through sound during playing the game and enhancing entertainment. In this case, the audio playback device must be firmly installed in the play tent or the play castle, and the audio playback device must be easily removed when disassembling

SUMMARY

In order to solve a problem that current entertainment equipment, such as play tents or play castles, are not able to play sound, the present disclosure provides an audio playback device. The audio playback device is firmly installed in the play tent or the play castle, and the audio playback device is easily removed when disassembling. Further, the audio playback device realizes human-computer interaction effect, allows children to deepen an impression through sound during playing a game, and enhances entertainment.

The present disclosure provides an audio playback device for a play tent and a play castle. The audio playback device comprises an audio player and a storage bin configured to accommodate the audio player. A bottom portion of the audio player is round table shaped. The bottom portion of the audio player extends radially outward to form a base of the audio player. A touch panel is arranged on a top portion of the audio player. The touch panel is configured to manually control playback of the audio player.

The storage bin comprises a soft cover configured to accommodate the audio player and an elastic ring connected to an opening of the soft cover. The elastic ring is configured to adjust a size of the opening of the soft cover. A bottom portion of the soft cover is fixed on the play tent. The base of the audio player contacts the play tent. At least a portion of a main body of the audio player extends from the elastic ring of the opening of the soft cover.

Furthermore, the base is a circular thin plate.

Furthermore, half of a maximum circumference of the elastic ring is no less than an outer diameter of the base of the audio player.

Furthermore, a minimum diameter of the elastic ring is no more than an outer diameter of the main body of the audio player.

Furthermore, a diameter of an inner cavity of the bottom portion of the soft cover is no less than the outer diameter of the base of the audio player.

Furthermore, the elastic ring comprises an elastic band and an annular soft sleeve integrated with the soft cover. The annular soft sleeve wraps the elastic band.

The present disclosure further provides a play tent. The play tent comprises a floor and a top wall. A plurality of side walls extend upward from an edge of the floor. The plurality of side walls are connected with the top wall to form an inner room of the play tent. The play tent further comprise the audio playback device mentioned above. Human-computer interaction is performed on the audio playback device to realize audio playback.

Furthermore, a bottom portion of the soft cover of the audio playback device extends radially outward to form a ring-shaped rim. The ring-shaped rim is fixedly connected to the floor.

Furthermore, the ring-shaped rim is fixedly connected to the floor by stitching or bonding.

The present disclosure further provides a play castle. The play castle comprises a tunnel, a castle wall, and the play tent mentioned above. A first end of the tunnel is connected with the castle wall, and a second end of the tunnel is connected with the play tent.

In the present disclosure, the audio playback device has a simple structure, is convenient to install and operate. The audio playback device is firmly installed in the play tent or the play castle, and the audio playback device is easily removed when disassembling. Further, the audio playback device is able to emit music, animal sounds, vehicle sounds, nature sounds, stories, songs, and/or any other required sounds by human-computer interaction effect, allows children to deepen an impression through sound during playing a game in the play tent and the play castle, and enhances entertainment.

BRIEF DESCRIPTION OF DRAWINGS

In order to clearly describe technical solutions in the embodiments of the present disclosure, the following will briefly introduce the drawings that need to be used in the description of the embodiments or the prior art. Apparently, the drawings in the following description are merely some of the embodiments of the present disclosure, and those skilled in the art are able to obtain other drawings according to the drawings without contributing any inventive labor. In the drawing.

DETAILED DESCRIPTION

Figure 1:
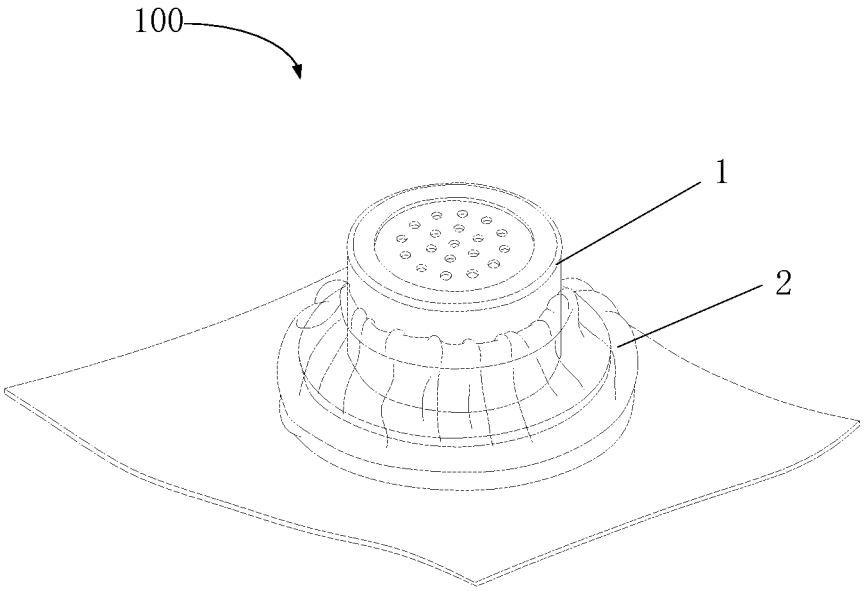
FIG. 1 is a schematic diagram showing a structure of an audio playback device according to one embodiment of the present disclosure.
Figure 2:
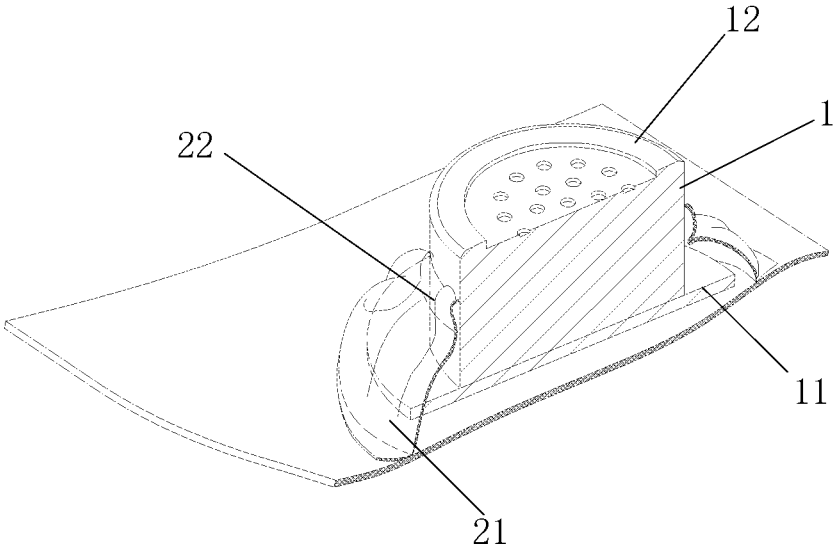
FIG. 2 is a cross-sectional schematic diagram of the audio playback device according to one embodiment of the present disclosure.
Figure 3:
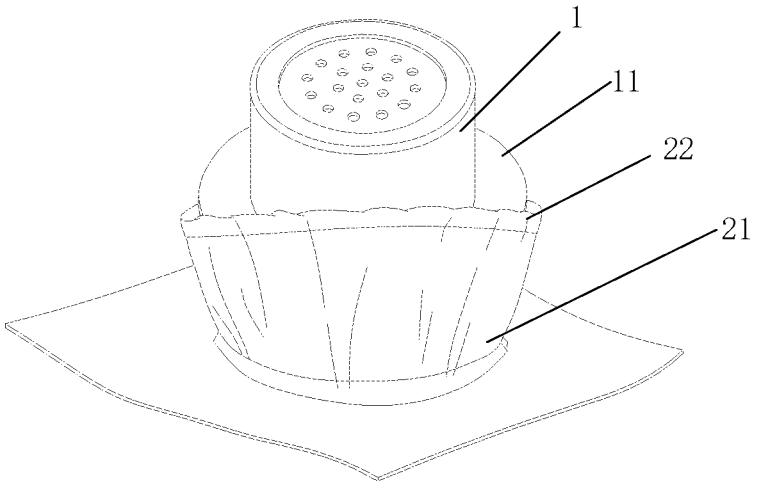
FIG. 3 is a schematic diagram of an audio playback device according to one embodiment of the present disclosure where an audio player is separated from a storage bin.
Figure 4:
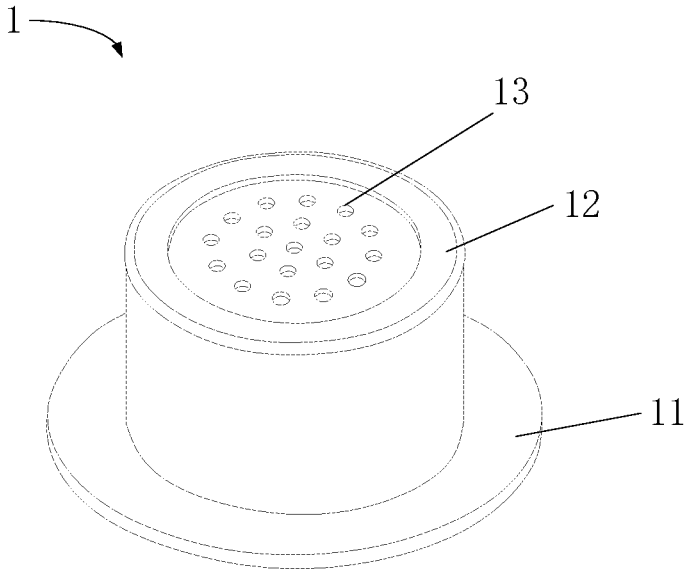
FIG. 4 is a schematic diagram of the audio player according to one embodiment of the present disclosure.
Figure 5:
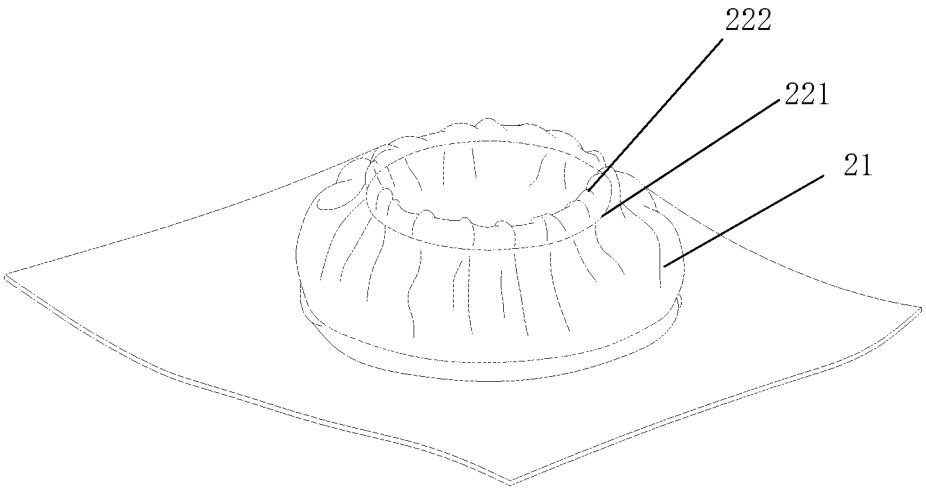
FIG. 5 is a schematic diagram of the storage bin according to one embodiment of the present disclosure.
Figure 6:
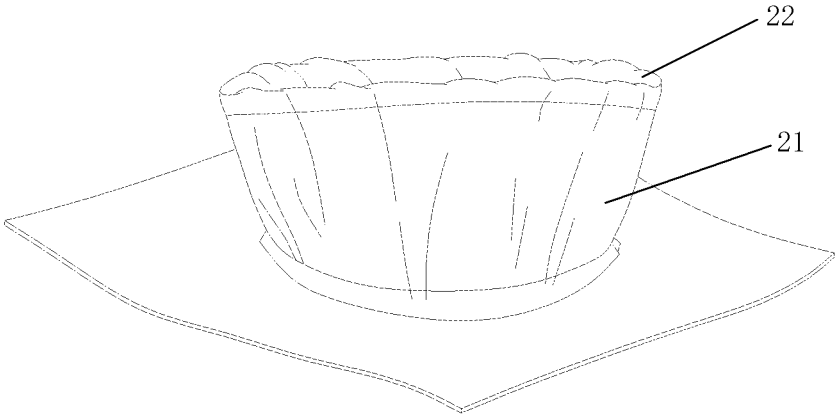
FIG. 6 is a schematic diagram of the storage bin according to one embodiment of the present disclosure where the storage bin is in an extended state.

Technical solutions in the embodiments of the present disclosure will be clearly and completely described below in conjunction with the accompanying drawings in the embodiments of the present disclosure. Obviously, the described embodiments are only a part of the embodiments of the present disclosure, rather than all of the embodiments. Based on the embodiments of the present disclosure, all other embodiments obtained by those of ordinary skill in the art without creative work shall fall within the protection scope of the present disclosure.

As shown in FIGS. 1-6, in one embodiment, the present disclosure provides an audio playback device 100. The audio playback device is able to emit music, animal sounds, vehicle sounds, nature sounds, stories, songs, and/or any other required sounds by human-computer interaction effect, allows children to deepen an impression through sound during playing a game, and enhances entertainment.

The audio playback device 100 comprises an audio player 1 and a storage bin 2 configured to accommodate the audio player 1. A bottom portion of the audio player 1 is round table shaped. The bottom portion of the audio player 1 extends radially outward to form a base 11 of the audio player 1. A touch panel 12 is arranged on a top portion of the audio player 1. The touch panel 12 is configured to manually control playback of the audio player 1. The touch panel 12 comprises through holes 13, through which sound is emitted from the audio player 1. The audio player 1 is able to emit music, animal sounds, vehicle sounds, nature sounds, stories, songs, and/or any other required sounds.

The storage bin 2 comprises a soft cover 21 configured to accommodate the audio player 1 and an elastic ring 22 connected to an opening of the soft cover 21. The elastic ring 22 is configured to adjust a size of the opening of the soft cover 21. A bottom portion of the soft cover 21 is fixed on the play tent. The base 11 of the audio player 1 contacts the play tent. At least a portion of a main body of the audio player 1 extends from the elastic ring 22 of the opening of the soft cover 21.

The base 11 is a circular thin plate. An outer diameter of the base is greater than an outer diameter of the main body of the audio player 1. The base 11 is completely received in the soft cover 21 and a portion of the main body of the audio player 1 is received in the soft cover 21. The other portion of the main body of the audio player 1 extends from the elastic ring 22 of the opening of the soft cover 21. In addition, the touch panel 12 of the audio player 1 extends from the elastic ring 22 to facilitate children to touch and control the audio player 1 to play audio during playing games.

In one specific embodiment, half of a maximum circumference of the elastic ring 22 is no less than an outer diameter of the base 11 of the audio player 1.

The elastic ring 22 has an elastic contraction function. When two ends of the elastic ring 22 are stretched to a maximum, the base of the audio player 1 is able to pass through the elastic ring 22. Since the base 11 is a circular thin plate, when the elastic ring 22 is stretched, half of the maximum circumference of the elastic ring 22 is greater than or equal to the outer diameter of the base 11, the base 11 that is the circular thin plate enters the soft cover 21 of the storage bin through the elastic ring 22. Optionally, when the elastic ring 22 is stretched, half of the maximum circumference of the elastic ring 22 is equal to the outer diameter of the base 11.

In one specific embodiment, a minimum diameter of the elastic ring 22 is no more than an outer diameter of the main body of the audio player 1.

The elastic ring 22 is configured to confine the base 11 of the audio player 1 in the soft cover 21. Since the outer diameter of the base 11 is greater than the outer diameter of the main body of the audio player 1, when the elastic ring 22 is contracted, the diameter of the elastic ring 22 is less than or equal to the outer diameter of the main body of the audio player 1, so the base 11 that is the circular thin plate is not easily detached from the elastic ring 22. Thus, the audio player 1 is firmly held in the soft cover 21.

In one specific embodiment, a diameter of an inner cavity of the bottom portion of the soft cover 21 is no less than the outer diameter of the base 11 of the audio player 1.

Optionally, when the diameter of the inner cavity of the bottom portion of the soft cover 21 is equal to the outer diameter of the base 11 of the audio player 1, the fixing of the audio player 1 is stable.

In one specific embodiment, the elastic ring 22 comprises an elastic band 221 and an annular soft sleeve 222 integrated with the soft cover 21. The annular soft sleeve 222 wraps the elastic band 221.

The elastic band 221 may be an elastic rope, an elastic rope or other belts or ropes with elastic contraction effect. Optionally, the annular soft sleeve 222 and the soft cover 21 are integrally formed. When the elastic band 221 is contracted, an upper portion of the annular soft sleeve 222 and an upper portion of the soft cover 21 form a wrinkle shape due to gathering and shrinking.

Figure 7:
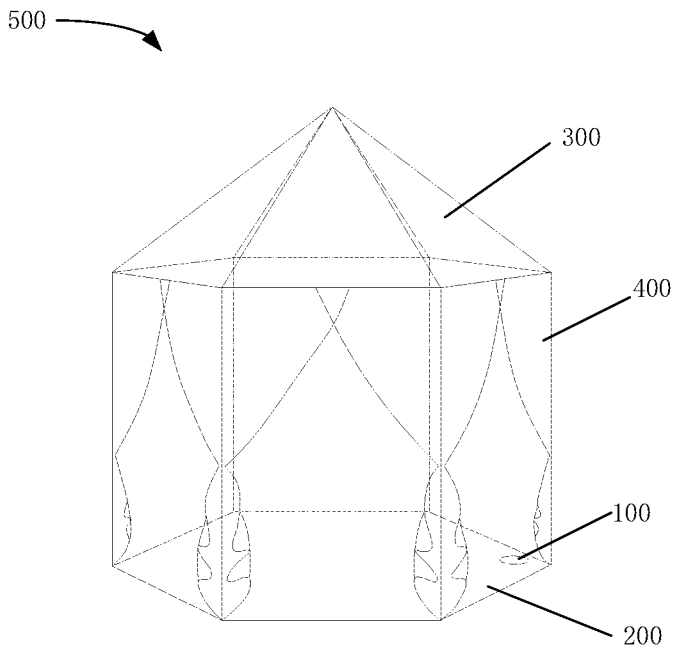
FIG. 7 is a schematic diagram showing a structure of a play tent according to one embodiment of the present disclosure.
Figure 8:
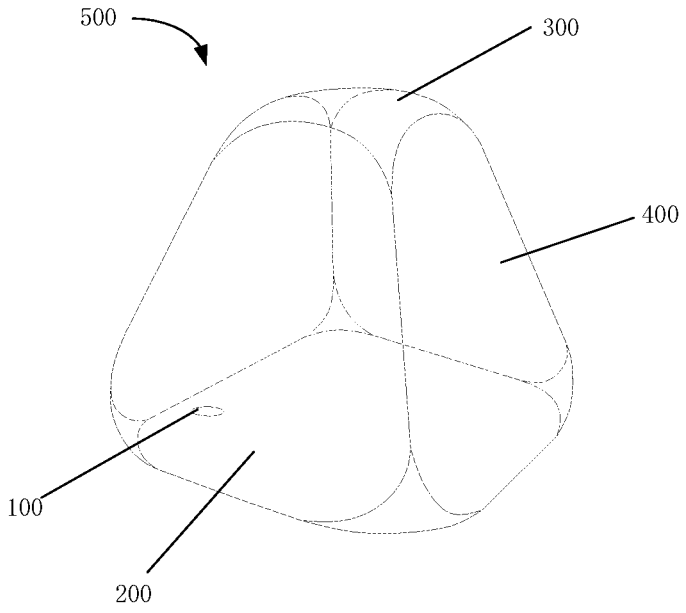
FIG. 8 is another schematic diagram showing the structure of the play tent according to one embodiment of the present disclosure.

As shown in FIGS. 7 and 8, the present disclosure further provides a play tent 500. The play tent 500 comprises a floor 200 and a top wall 300. A plurality of side walls 400 extend upward from an edge of the floor 200. The plurality of side walls 400 are connected with the top wall 300 to form an inner room of the play tent 500. The play tent 500 further comprise the audio playback device 100 mentioned above. Human-computer interaction is performed on the audio playback device 100 to realize audio playback.

The audio playback device 100 is a human-computer interactive audio playback device configured to emit a variety of simulated scene sounds by touching the touch panel. The simulated scene sounds can be music, animal sounds, vehicle sounds, nature sounds, stories, songs and/or any other required sounds. Optionally, appropriate sounds are selected to match the game project plan, for example, a jungle game plan with jungle animal sounds.

In one specific embodiment, the bottom portion of the soft cover of the audio playback device 100 extends radially outward to form a ring-shaped rim. The ring-shaped rim is fixedly connected to the floor 200. The audio playback device 100 is fixed on the floor 200 of the play tent 500 so that it is not easy for the children to remove the audio playback device 100 from the play tent 500.

The ring-shaped rim of the audio playback device 100 is fixedly connected to the floor 200 by stitching or bonding.

Optionally, the ring-shaped rim of the audio playback device 100 is fixedly connected to the floor 200 by stitching.

Figure 9:
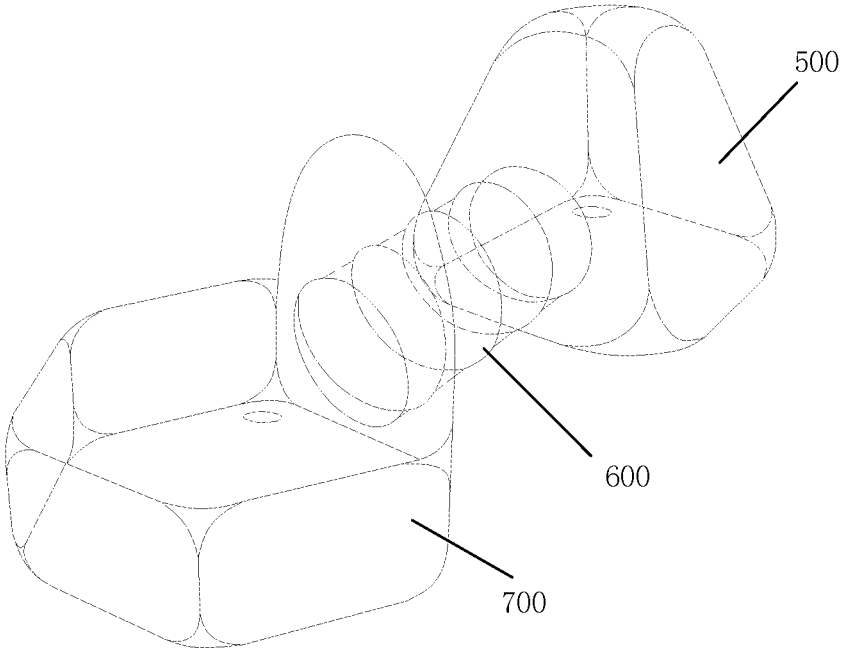
FIG. 9 is a schematic diagram showing a structure of a play castle according to one embodiment of the present disclosure.

As shown in FIGS. 7-9, the present disclosure further provides a play castle. The play castle comprises a tunnel 600, a castle wall 700, and the play tent 500 mentioned above. A first end of the tunnel 600 is connected with the castle wall 700, and a second end of the tunnel 600 is connected with the play tent 500.

The play tent 500 comprises the floor 200 and the top wall 300. The plurality of side walls 400 extend upward from the edge of the floor 200. The plurality of side walls 400 are connected with the top wall 300 to form the inner room of the play tent 500. The play tent 500 further comprise the audio playback device 100 mentioned above. Human-computer interaction is performed on the audio playback device 100 to realize audio playback.

It should be noted that the bottom portion of the soft cover of the audio playback device 100 comprises the ring-shaped rim that extends radially outwards and is fixedly connected to the floor 200 of the play tent 500, or the bottom of the soft cover of the audio playback device 100 comprises the ring-shaped rim that extends radially outwards and is fixedly connected to a surface of the castle wall 700. In summary, the audio playback device 100 can be fixedly connected to any other required portion of the play castle.

In the present disclosure, the audio playback device 100 has a simple structure, is convenient to install and operate. The audio playback device is firmly installed in the play tent or the play castle, and the audio playback device is easily removed when disassembling. Further, the audio playback device is able to emit music, animal sounds, vehicle sounds, nature sounds, stories, songs, and/or any other required sounds by human-computer interaction effect, allows children to deepen an impression through sound during playing a game in the play tent and the play castle, and enhances entertainment.

Although optional embodiments of the present disclosure have been described, those skilled in the art are able to make additional changes and modifications to these embodiments once they learn the basic creative concept of the present disclosure. Therefore, the appended claims are intended to be interpreted as including the optional embodiments and all changes and modifications falling within the scope of the present disclosure.

Obviously, those skilled in the art are able to make various changes and modifications to the embodiments of the present disclosure without departing from the spirit and scope of the embodiments of the present disclosure. In this way, if these modifications and variations of the embodiments of the present disclosure fall within the scope of the claims of the present disclosure and their equivalent technologies, the present disclosure is also intended to include these modifications and variations.

What is claimed is:

1. An audio playback device, comprising:

an audio player; and a storage bin configured to accommodate the audio player;

wherein a bottom portion of the audio player is round table shaped; the bottom portion of the audio player extends radially outward to form a base of the audio player; a touch panel is arranged on a top portion of the audio player; the touch panel is configured to manually control playback of the audio player;

wherein the storage bin comprises a soft cover configured to accommodate the audio player and an elastic ring connected to an opening of the soft cover; the elastic ring is configured to adjust a size of the opening of the soft cover; a bottom portion of the soft cover is fixed on a play tent or a play castle; the base of the audio player contacts the play tent or the play castle, at least a portion of a main body of the audio player extends from the elastic ring of the opening of the soft cover.

2. The audio playback device according to claim 1, wherein the base is a circular thin plate.

3. The audio playback device according to claim 2, wherein half of a maximum circumference of the elastic ring is no less than an outer diameter of the base of the audio player.

4. The audio playback device according to claim 3, wherein a minimum diameter of the elastic ring is no more than an outer diameter of the main body of the audio player.

5. The audio playback device according to claim 3, wherein a diameter of an inner cavity of the bottom portion of the soft cover is no less than the outer diameter of the base of the audio player.

6. The audio playback device according to claim 4, wherein the elastic ring comprises an elastic band and an annular soft sleeve integrated with the soft cover; the annular soft sleeve wraps the elastic band.

7. A play tent, comprising:

a floor and a top wall;

wherein a plurality of side walls extend upward from an edge of the floor; the plurality of side walls are connected with the top wall to form an inner room of the play tent; the play tent further comprise an audio playback device; human-computer interaction is performed on the audio playback device to realize audio playback; the audio playback device comprises an audio player and a storage bin configured to accommodate the audio player;

wherein a bottom portion of the audio player is round table shaped; the bottom portion of the audio player extends radially outward to form a base of the audio player; a touch panel is arranged on a top portion of the audio player; the touch panel is configured to manually control playback of the audio player;

wherein the storage bin comprises a soft cover configured to accommodate the audio player and an elastic ring connected to an opening of the soft cover; the elastic ring is configured to adjust a size of the opening of the soft cover; a bottom portion of the soft cover is fixed on the play tent; the base of the audio player contacts the play tent, at least a portion of a main body of the audio player extends from the elastic ring of the opening of the soft cover.

8. The play tent according to claim 7, wherein a bottom portion of the soft cover of the audio playback device extends radially outward to form a ring-shaped rim; the ring-shaped rim is fixedly connected to the floor.

9. The play tent according to claim 8, wherein the ring-shaped rim is fixedly connected to the floor by stitching or bonding.

10. A play castle, comprising:

a tunnel, a castle wall, and a play tent;

wherein a first end of the tunnel is connected with the castle wall, and a second end of the tunnel is connected with the play tent; wherein the play tent comprises a floor and a top wall;

wherein a plurality of side walls extend upward from an edge of the floor; the plurality of side walls are connected with the top wall to form an inner room of the play tent; the play tent further comprise an audio playback device; human-computer interaction is performed on the audio playback device to realize audio playback; the audio playback device comprises an audio player and a storage bin configured to accommodate the audio player;

wherein a bottom portion of the audio player is round table shaped; the bottom portion of the audio player extends radially outward to form a base of the audio player, and a touch panel is arranged on a top portion of the audio player; the touch panel is configured to manually control playback of the audio player;

wherein the storage bin comprises a soft cover configured to accommodate the audio player and an elastic ring connected to an opening of the soft cover; the elastic ring is configured to adjust a size of the opening of the soft cover; a bottom portion of the soft cover is fixed on the play tent; the base of the audio player contacts the play tent, at least a portion of a main body of the audio player extends from the elastic ring of the opening of the soft cover.

* * * * *